US009331435B2

(12) United States Patent
Kondo

(10) Patent No.: US 9,331,435 B2
(45) Date of Patent: May 3, 2016

(54) CONNECTOR WITH ELECTRONIC COMPONENT

(71) Applicant: Sumitomo Wiring Systems, Ltd., Yokkaichi, Mie (JP)

(72) Inventor: Tomoyuki Kondo, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 14/291,270

(22) Filed: May 30, 2014

(65) Prior Publication Data

US 2014/0364009 A1 Dec. 11, 2014

(30) Foreign Application Priority Data

Jun. 11, 2013 (JP) ..... 2013-122321

(51) Int. Cl.
*H01R 13/6464* (2011.01)
*H01R 13/66* (2006.01)

(52) U.S. Cl.
CPC ..... *H01R 13/6625* (2013.01)

(58) Field of Classification Search
CPC ..... H01R 13/6625; H01R 13/6464; H05K 2201/10325
USPC ..... 439/620.09, 620.21, 694; 361/301.2
See application file for complete search history.

(56) References Cited

U.S. PATENT DOCUMENTS

| | | | | |
|---|---|---|---|---|
| 8,254,146 | B2 * | 8/2012 | Kuo et al. | 361/811 |
| 8,553,429 | B2 * | 10/2013 | McNamara et al. | 361/810 |
| 2012/0077356 | A1 * | 3/2012 | Shimizu et al. | 439/55 |
| 2012/0129392 | A1 * | 5/2012 | Fujisaki | 439/587 |
| 2013/0040504 | A1 | 2/2013 | Takemoto et al. | |

FOREIGN PATENT DOCUMENTS

JP 2013-38051 2/2013

* cited by examiner

*Primary Examiner* — James Harvey
*Assistant Examiner* — Matthew T Dzierzynski
(74) *Attorney, Agent, or Firm* — Gerald E. Hespos; Michael J. Porco; Matthew T. Hespos

(57) ABSTRACT

A connector includes a holder (20) and an electronic component (60) with a cylindrical main body (61). Lead wires (62) project axially from one axial end (61A) of the main body (61). An electronic component holding portion (35) is in the holder (20) and includes an insertion opening (39) into which the electronic component (60) is inserted. Projecting portions (64) are formed on the lead wires (62) and project radially out beyond an outer peripheral surface of the main body (61). The electronic component holding portion (35) includes a main body accommodating portion (36) for accommodating the main body (61) and guides (37) that communicate with the main body accommodating portion (36). The guides (37) are located radially outward of the main body (61) and guide the projecting portions (64) toward back sides in an inserting direction while suppressing circumferential movements of the projecting portions (64).

9 Claims, 12 Drawing Sheets

CONNECTOR WITH ELECTRONIC COMPONENT

BACKGROUND

1. Field of the Invention

The invention relates to a connector with an electronic component.

2. Description of the Related Art

A connector with a built-in electronic component, such as a capacitor, is known to be installed in an automotive vehicle for removing noise of electric/electronic devices and the like or the like. A lead wire of the capacitor is inserted into the connector and guided to a predetermined position for connection to a terminal. The capacitor generally has a cylindrical shape, and hence it is necessary to prevent rotation of the capacitor. Accordingly, Japanese Unexamined Patent Publication No. 2013-38051 discloses a technique for forming an insertion hole in a back wall of a capacitor holder and passing the lead wire through the insertion hole. However, this technique requires a complicated die and increases cost. Further, the lead wire contacts the back wall or it becomes difficult to insert the lead wire into the hole in the back wall if the capacitor rotates before the lead wire reaches the capacitor holder.

The invention was completed based on the above situation and aims to provide a connector with an electronic component capable of easily suppressing rotation of an electronic component.

SUMMARY OF THE INVENTION

The invention is directed to a connector with an electronic component, including a holder and an electronic component including a solid cylindrical electronic component main body and a lead wire projecting in an axial direction from one axial end surface of the electronic component main body. An electronic component holding portion is formed in the holder and includes an insertion opening into which the electronic component is inserted in the axial direction of the electronic component main body. The electronic component holding portion is configured to hold the electronic component main body. The connector further includes a terminal to be connected to the lead wire. A projection is formed on a projecting end part of the lead wire and projects radially out from an outer peripheral surface of the electronic component main body. The electronic component holding portion includes a main body accommodating portion for accommodating the electronic component main body and a guide communicating with the main body accommodating portion. The guide is located radially outward of the electronic component main body and is configured to guide the projection toward a back side in an inserting direction from the insertion opening of the electronic component holding portion while suppressing a circumferential movement of the projecting portion.

The projection is formed on the projecting end part of the lead wire and projects radially out from the outer peripheral surface of the electronic component. This projecting end part of the lead wire is inserted first into the insertion opening of the electronic component holding portion when inserting the electronic component into the electronic component holding portion. At that time, the projection is inserted into the guide and the guide suppresses circumferential movement of the electronic component. Further, the guide and the projection can be positioned in the insertion opening so that positioning is facilitated. Furthermore, the guide arranges the lead wire at a predetermined position and prevents collision of the lead wire with the electronic component holding portion.

The electronic component holding portion may define a hollow cylinder that is open in a front-back inserting direction. The guide may be a groove in a part of the hollow cylindrical electronic component holding portion. The lead wire may be formed with the projection by bending or cranking an end part thereof toward a radially outer side after projecting in the axial direction from the end of the electronic component main body. The groove in the hollow cylindrical electronic component holding portion is formed relatively easily. The outwardly bent part of the lead wire near the electronic component main body is inserted into that groove to suppress circumferential movement. Further, by bending the lead wire near the electronic component main body, a part of the lead wire over substantially the entire length serves as the projection and a part of the lead wire to be guided by the guide when inserting the electronic component becomes longer.

The holder may include a terminal holding portion capable of holding the terminal; and the terminal holding portion and the electronic component holding portion may be coupled while leaving a space where the terminal and the lead wire are weldable. With this configuration, the holder holds both members when the lead wire and the terminal are welded. Thus, operability can be improved.

DETAILED DESCRIPTION OF THE PREFERRED EMBODIMENTS

Figure 1:
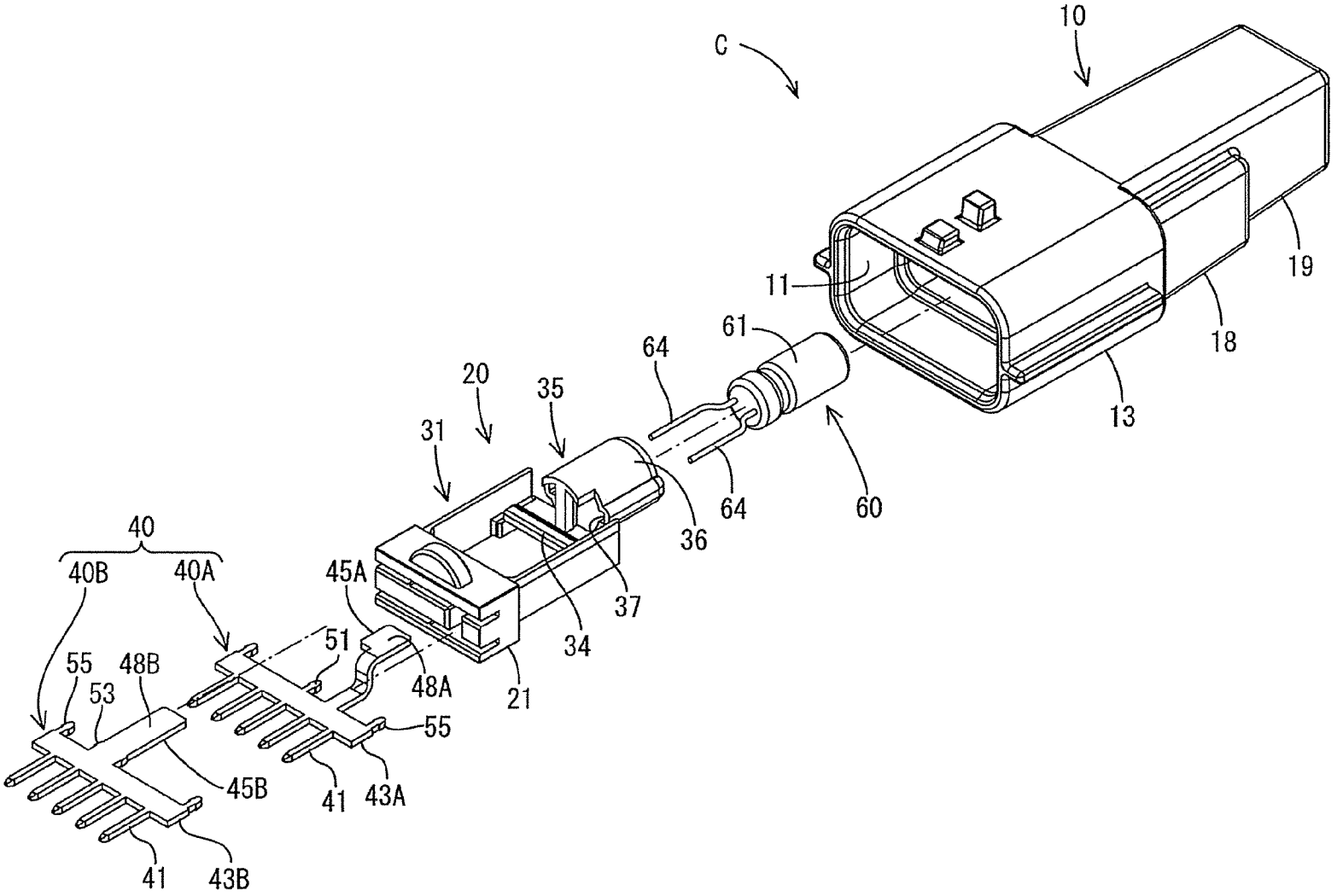
FIG. 1 is an exploded perspective view of a connector with an electronic component according to one embodiment of the invention.

A connector in accordance with an embodiment of the invention is identified by the letter C. The connector C is a joint connector for collectively connecting unillustrated wires drawn out from electric/electronic devices installed in an automotive vehicle and includes an electronic component for removing noise of the electric/electronic devices. The connector C includes a bag-shaped housing 10 open only in one direction, and a holder 20 is housed in the housing 10. Positive and negative busbars 40 are held in the holder 20 and a capacitor 60 is held between the busbars 40 so that the busbars 40 are held respectively on positive and negative electrode sides of the capacitor 60. The connector C is connectable to a mating connector 80 (see FIG. 15). In the following description, a connection end of the connector C to be connected to the mating connector 80 is referred to as the front end and an opposite end is referred to as a rear end in each constituent member, and vertical and lateral directions are based on FIG. 2.

The housing 10 is made of synthetic resin and includes an insertion opening 11 into which the holder 20 is insertable from the front, as shown in FIG. 1. The housing 10 has a receptacle 13 that forms the insertion opening 11 and into which the mating connector 80 (see FIG. 15) is fit. A holder accommodating portion 18 is rearward of the receptacle 13 and is configured to accommodate an intermediate portion 31 of the holder 20. A capacitor accommodating portion 19 is rearward of the holder accommodating portion 18 and is configured to accommodate the capacitor 60. The receptacle 13, the holder accommodating portion 18 and the capacitor accommodating portion 19 are formed unitarily to define a three-step structure.

The busbars 40 are formed by punching an electrically conductive plate material, such as metal, and applying bending and the like to the punched-out pieces, as shown in FIG. 1. Each busbar 40 includes five tab-shaped terminals 41 to be connected to female terminal fittings held in the mating connector 80 (see FIG. 15). The terminals 41 of each busbar 40 project side by side at constant intervals from a front end of a strip-like coupling 43 in a comb-teeth manner. Each busbar 40 also has an electronic component connecting portion 45 that projects perpendicularly rearward from the rear end of the strip-like coupling 43 for connection to the capacitor 60.

Figure 10:
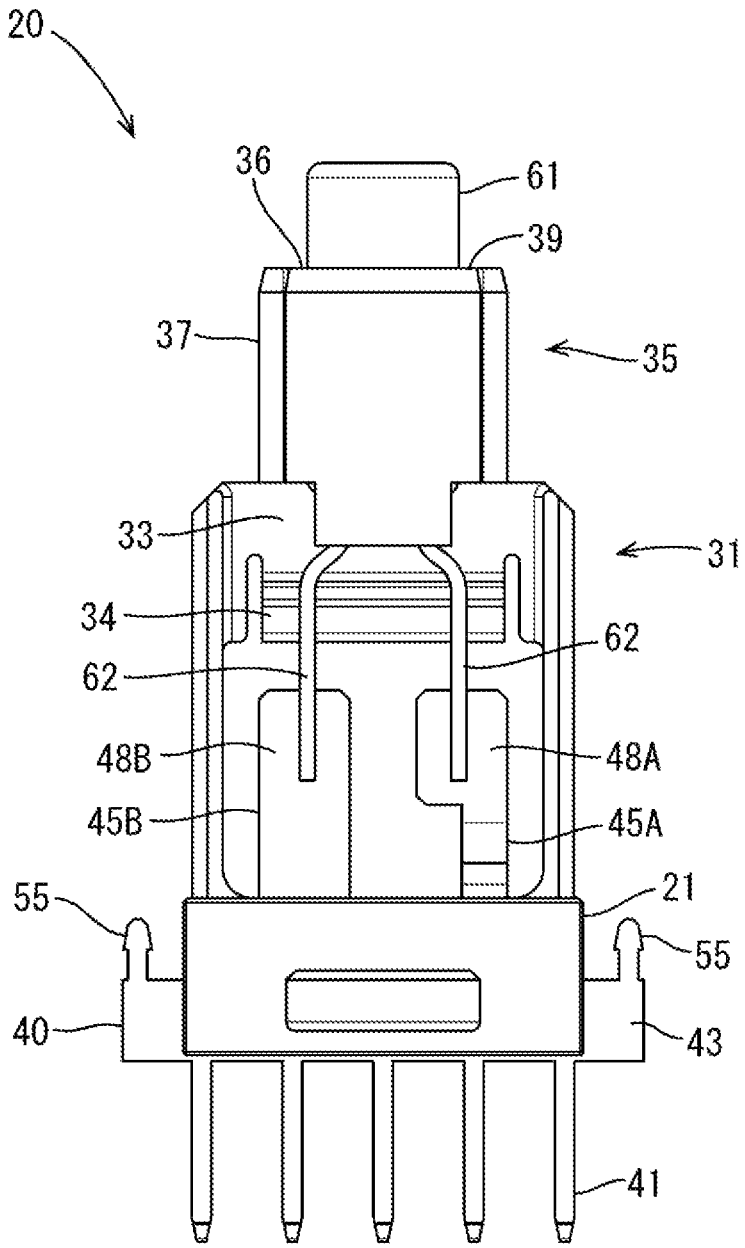
FIG. 10 is a plan view showing the state where the terminal fittings and the capacitor are mounted in the holder.
Figure 11:
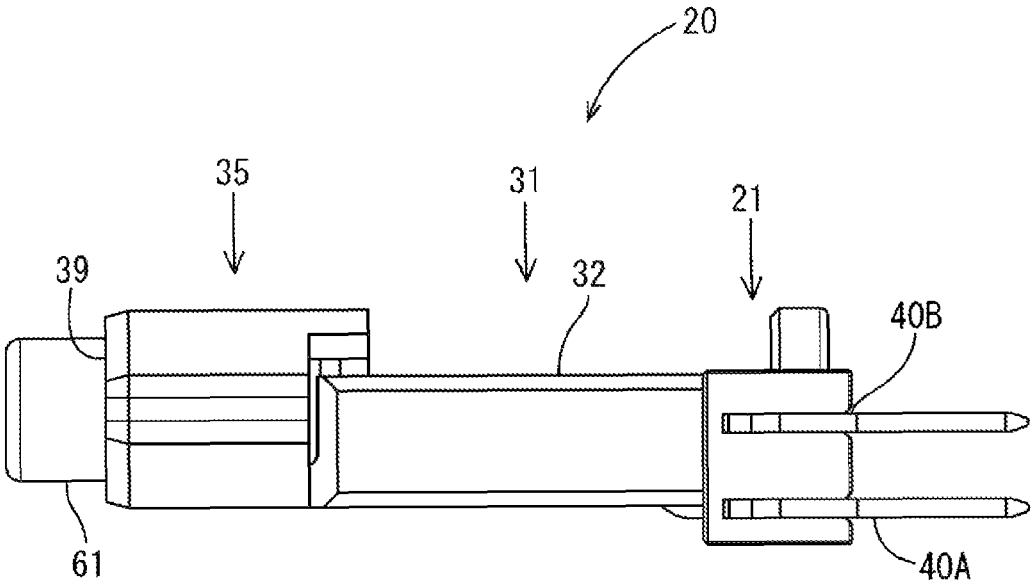
FIG. 11 is a side view showing the state where the terminal fittings and the capacitor are mounted in the holder.
Figure 12:
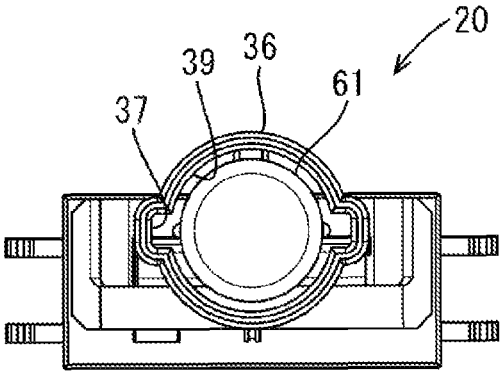
FIG. 12 is a rear view showing the state where the terminal fittings and the capacitor are mounted in the holder.
Figure 13:
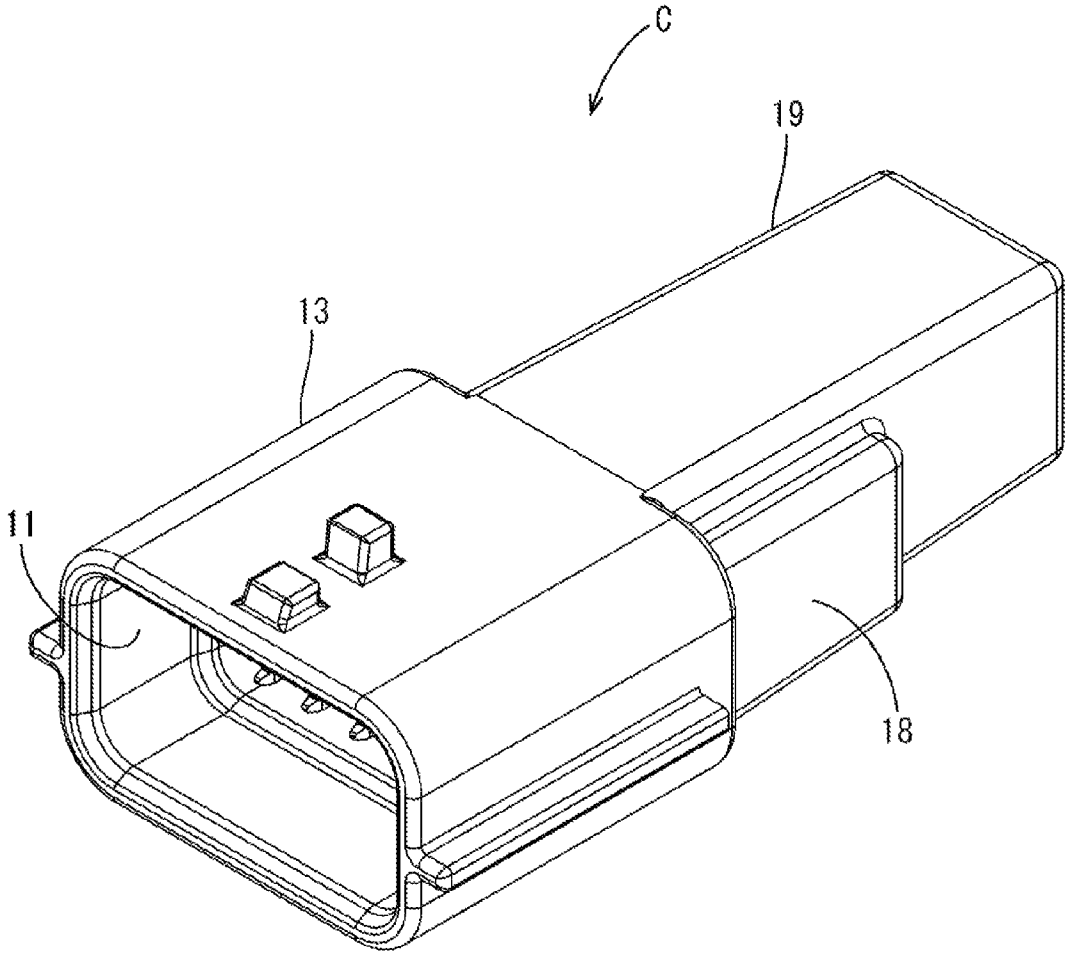
FIG. 13 is a perspective view of the connector with the electronic component.
Figure 14:
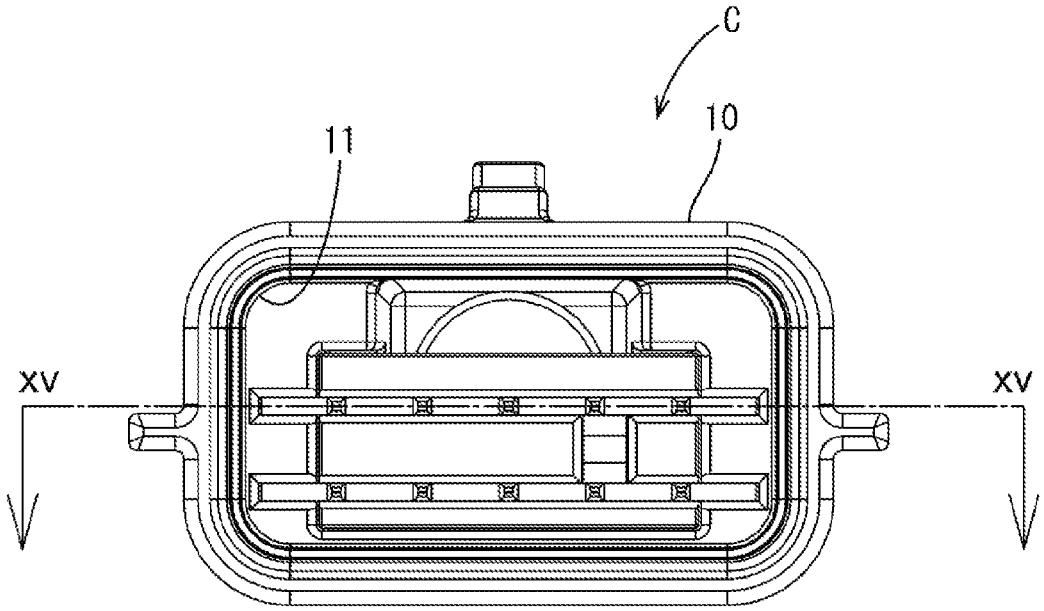
FIG. 14 is a front view of the connector with the electronic component.

As shown in FIG. 10, a lateral length of each strip-like coupling 43 exceeds a width of a busbar holding portion 21 of the holder 20. Thus, when the busbars 40 are mounted into the holder 20, the strip-like couplings 43 project from opposite left and right sides of the busbar holding portion 21.

Figure 8:
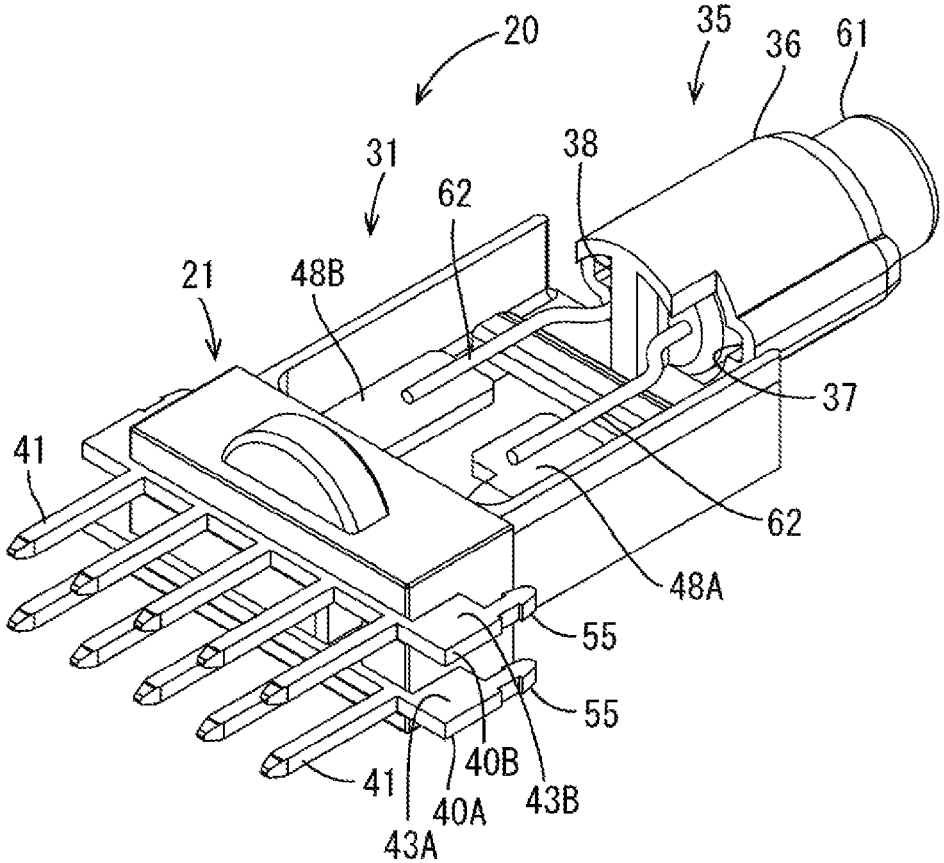
FIG. 8 is a perspective view showing a state where terminal fittings and the capacitor are mounted in the holder.
Figure 9:
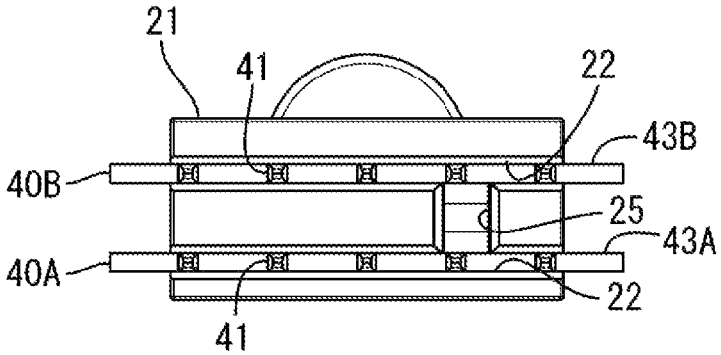
FIG. 9 is a front view showing the state where the terminal fittings and the capacitor are mounted in the holder.

Positive and negative busbars 40 are arranged in upper and lower levels in a height direction of the holder 20, as shown in FIG. 8. The busbar 40 in the lower level is referred to as a first busbar or first conductive member 40A and the busbar 40 in the upper level is referred to as a second busbar or second conductive member 40B.

A first electronic component connecting portion 45A of the first busbar 40A and a second electronic component connecting portion 45B of the second busbar 40B are at a fixed lateral distance from each other when mounted in the holder 20, as shown in FIG. 10.

As shown in FIG. 1, the second electronic component connecting portion 45B projects back from a position of the second strip-like coupling 43B displaced to the left of center in the lateral direction of the holder 20 and forms a second welding portion 48B to be welded to a lead wire 62 of the capacitor 60. The second electronic component connecting portion 45B is flat without any step over the entire length including the second welding portion 48B. Thus, the entire second busbar 40B is flat. Note that a width of the second electronic component connecting portion 45B has a substantially constant width over the entire length excluding second press-fit portions 53.

Figure 15:
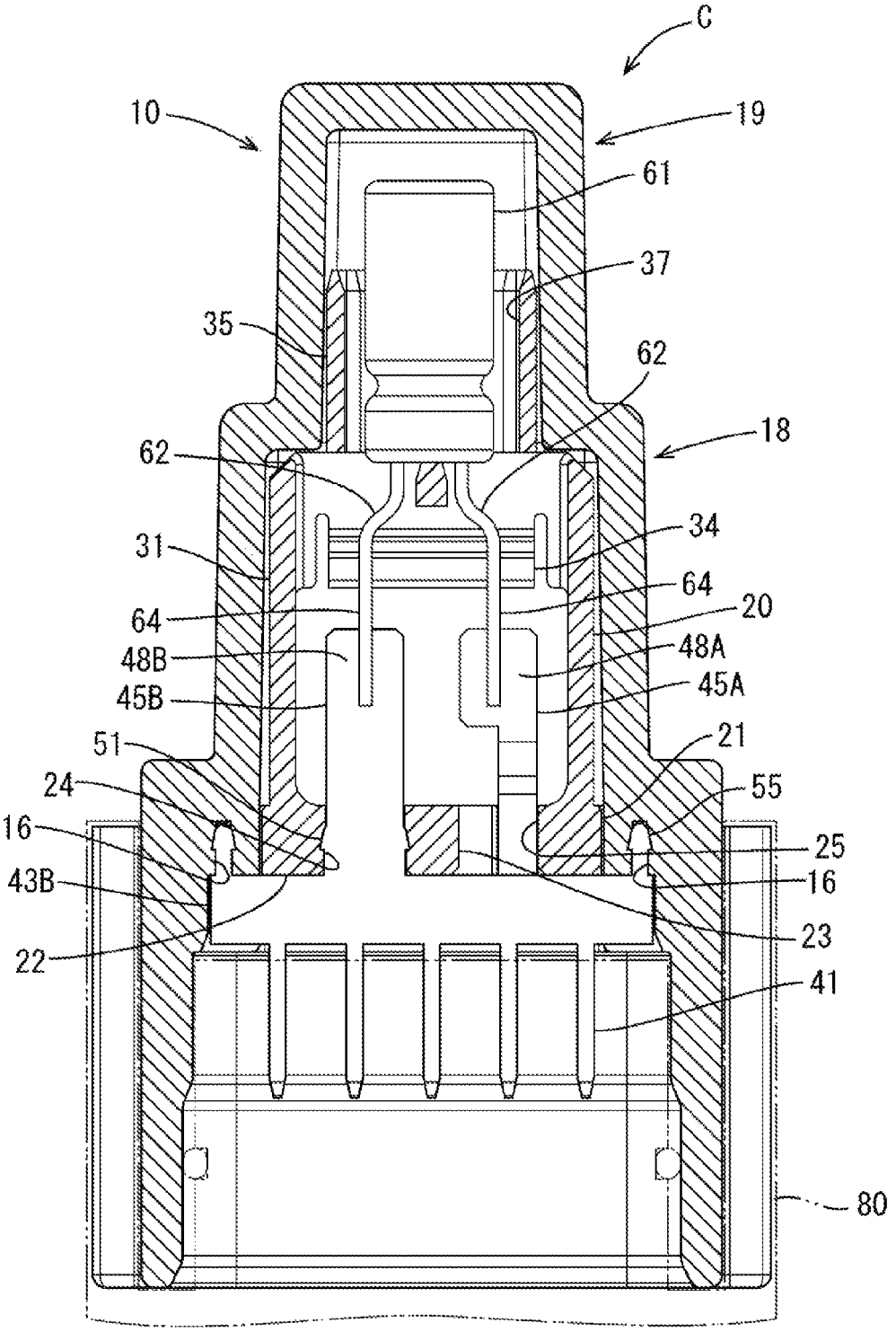
FIG. 15 is a plan view partly in section at a position xv-xv of FIG. 14.

The second electronic component connecting portion 45B is formed with the second press-fit portions 53. The second press-fit portions 53 are wider toward the front, and these wider parts bite into resin as the second press-fit portions 53 are press-fit into a second connecting portion insertion hole 24 (see FIG. 7). Specifically, the second press-fit portions 53 are on opposite left and right sides of the second electronic component connecting portion 45B to define a wedge shape. As shown in FIG. 15, the second press-fit portions 53 hold the second busbar 40B at a predetermined position in the holder 20 by being locked substantially in a lengthwise central part of the busbar holding portion 21 in a front-back direction.

As shown in FIG. 1, the first electronic component connecting portion 45A projects back from a position displaced to the right from a lateral center of the first strip-like coupling 43A and forms a first welding portion 48A to be welded to a lead wire 62 of the capacitor 60. The first electronic component connecting portion 45A is bent at a right angle twice at intermediate positions in the front-back direction so that the first welding portion 48A on the tip thereof is at substantially the same height as the second electronic component connecting portion 45B. Specifically, the first electronic component connecting portion 45A is bent back at the same height position as the second electronic component connecting portion 45B after being bent up at an intermediate position in the length direction. Further, the welding portion 48A of the first electronic component connecting portion 45A is slightly wider than a bent part.

As shown in FIG. 1, the first busbar 40A includes a first press-fit portion 51 to be press-fit into a holder press-fit hole 26 (see FIG. 4) in the holder 20 by being pushed back relative to the busbar holding portion 21 of the holder 20. The first press-fit portion 51 projects from the first strip-like coupling 43A toward the same side as the first electronic component connecting portion 45A, i.e. toward a side opposite to the first terminals 41. The first press-fit portion 51 is shorter than the busbar holding portion 21 in the front-back direction. Further, a tip of the first press-fit portion 51 is wedge-shaped.

As shown in FIGS. 1 and 15, each busbar 40 includes housing press-fit portions 55 to be press-fit into housing press-fit holes 16 formed in the housing 10 by being pushed back relative to the housing 10. The housing press-fit portions 55 project from the same side of the strip-like coupling as the electronic component connecting portion 45, and hence from the side opposite to the terminal portions 41. Lengths of the housing press-fit portions 55 substantially equal the length of the first press-fit portion 55, and tips thereof are wedge-shaped. Further, two housing press-fit portions 55 are provided on opposite lateral ends of each strip-like coupling 43. The housing press-fit portions 55 are arranged to project to both left and right sides from the busbar holding portion 21 when the busbars 40 are mounted into the holder 20.

Figure 7:
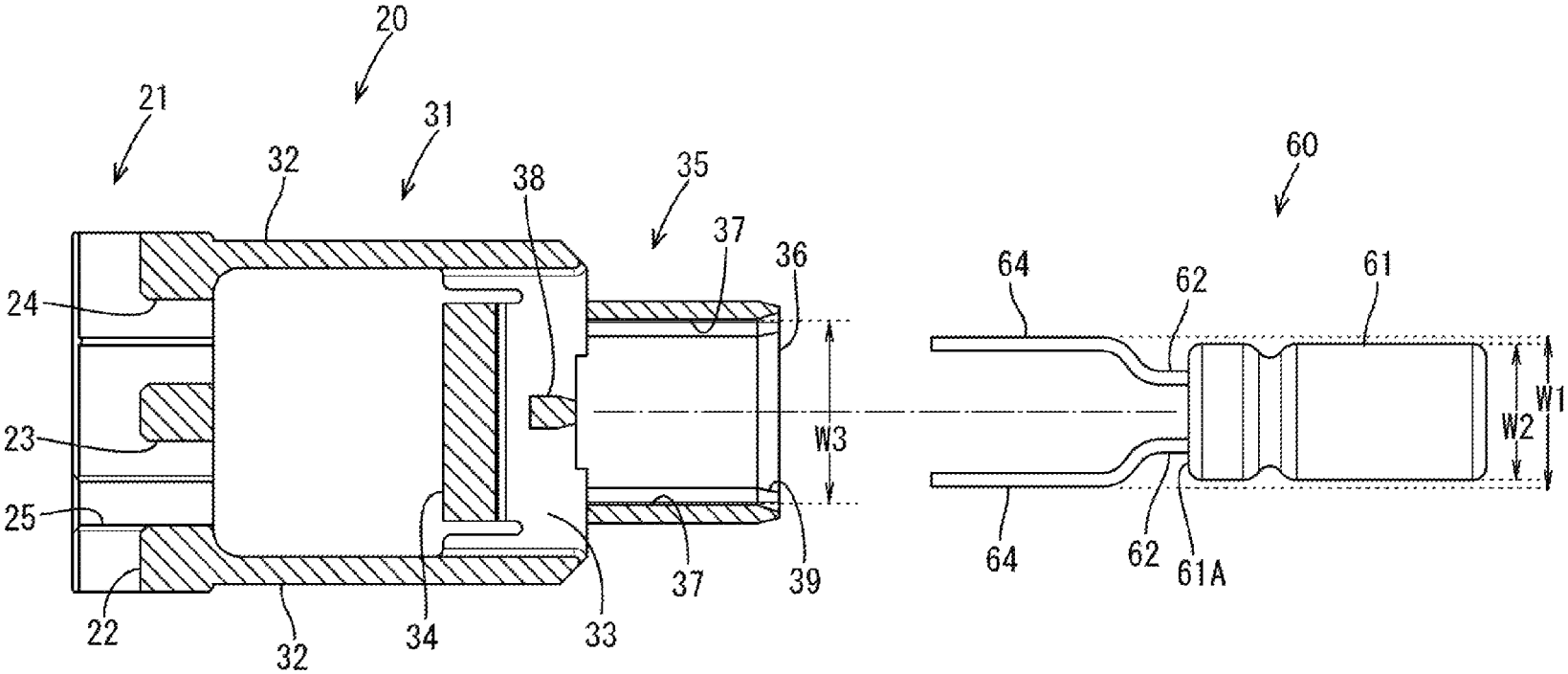
FIG. 7 is a view showing a state where a capacitor is mounted in the holder shown in section at a position VII-VII of FIG. 4.

As shown in FIG. 7, the capacitor 60 is an aluminum electrolytic capacitor with a substantially solid cylindrical capacitor main body 61 and positive and negative pin-shaped lead wires 62 drawn out forward from a front end surface 61A of the capacitor main body 61. The lead wires 62 are bent toward sides radially outward of the outer peripheral surface of the capacitor main body 61 and then extend forward at positions outward of the outer peripheral surface of the capacitor main body 61 to form projecting portions 64. More particularly, the lead wires 62 are bent radially out immediately after projecting from the front end surface 61A of the capacitor main body 61 and are bent again to extend forward when a distance W1 between outer sides of the lead wires 62 exceeds a width (outer diameter) W2 of the outer peripheral surface of the capacitor main body 61 to define the projecting portions 64 located radially outward of the outer peripheral surface of the capacitor main body 61. The lead wires 62 are arranged above the electronic component connecting portions 45 of the busbar pieces 40 when being mounted, and are connected to the electronic component connecting portions 45 by resistance welding.

The holder 20 is made of synthetic resin and, as shown in FIG. 8, is long and narrow in the front-back direction. The busbar holding portion 21 for holding the busbars 40 is on a front end of the holder 20 and an electronic component holding portion 35 for holding the capacitor 60 is on a rear end thereof. The busbars 40 and the capacitor 60 are connected in the intermediate portion 31 between the busbar holding portion 21 and the electronic component holding portion 35 of the holder 20. Note that the electronic component holding portion 35 is in a substantially widthwise center of the holder 20.

Figure 4:
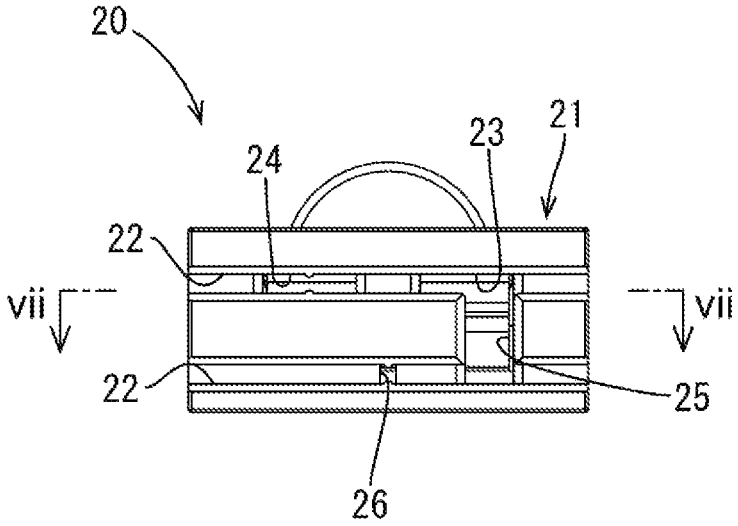
FIG. 4 is a front view of a holder.

As shown in FIG. 8, the busbar holding portion 21 is a wide substantially rectangular block and, as shown in FIG. 4, has forwardly open mounting grooves 22 for receiving the strip-like couplings 43 of the busbars 40 from the front. The mounting grooves 22 are sufficiently long to open in both lateral directions in addition to the forward direction. The busbars 40 are stopped at rear end positions when rear end surfaces of the strip-like couplings 43 contact the rear surfaces of the mounting grooves 22, as shown in FIG. 15. Further, the mounting grooves 22 are formed in two upper and lower levels in the busbar holding portion 21.

As shown in FIG. 7, a second connecting portion insertion hole 24 penetrates the back surface of the mounting groove 22 in the upper level and can receive the second electronic component connecting portion 45B of the second busbar 40B. The second electronic component connecting portion 45B is inserted into the mounting groove 22 from the front and projects into the intermediate portion 31 through the second connecting portion insertion hole 24. A width of the second connecting portion insertion hole 24 substantially equals a width of the second electronic component connecting portion 45B.

As shown in FIG. 4, the busbar holding portion 21 has an insertion hole 25 that allows the mounting grooves 22 in the upper and lower levels to communicate in the vertical direction. The insertion hole 25 is slightly wider than the bent part of the first electronic component connecting portion 45A and can receive the bent part of the first electronic component connecting portion 45A of the first busbar 40A. Further, as shown in FIG. 7, a first connecting portion insertion hole 23 penetrates through the back surface of the mounting groove 22 in the upper level and receives the welding portion 48A of the first electronic component connecting portion 45A. As shown in FIG. 8, the welding portion 48A of the first electronic component connecting portion 45A is inserted into the mounting groove 22 in the upper level from the front, through the first connecting portion insertion hole 23 and projects into the intermediate portion 31. At that time, the bent part is inserted into the insertion hole 25. The first connecting portion insertion hole 23 is wider than the insertion hole 25 and enables insertion of the welding portion 48A of the first electronic component connecting portion 45A.

Further, as shown in FIG. 4, the holder press-fit hole 26 is on the back surface of the mounting groove 22 in the lower level at a position corresponding to the first press-fit portion 51 of the first busbar 40A. The holder press-fit hole 26 is in a substantially widthwise center of the busbar holding portion 21 and penetrates to a rear side of the busbar piece holding portion 21.

Figure 5:
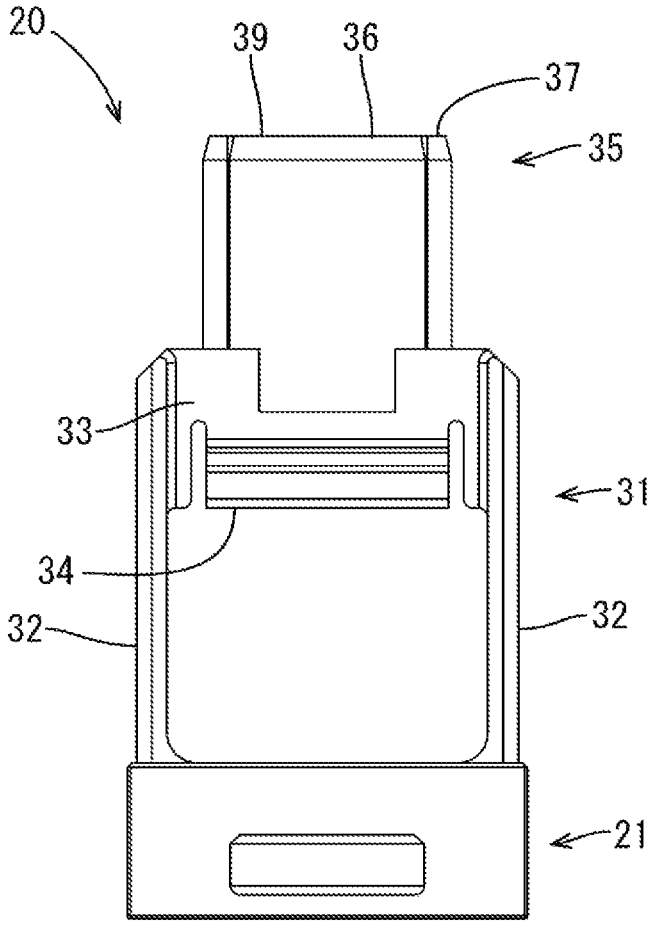
FIG. 5 is a plan view of the holder.

As shown in FIGS. 5 and 7, the intermediate portion 31 has two side walls 32 that face each other in the width direction, an intermediate coupling 33 that couples the side walls 32 and a lead wire support 34 for supporting the lead wires 62 from below. The side walls 32 face each other substantially in parallel and their front ends are coupled to the busbar holding portion 21. The intermediate coupling 33 couples rear end parts of the side walls 32 and also is coupled to the electronic component holding portion 35 by being unitary with a lower part of a spacer 38. The lead wire support 34 for supporting the lead wires 62 of the capacitor 60 is on the front end of the intermediate coupling 33. The lead wire supporting 34 is cantilevered forward from the intermediate coupling 33 and is resiliently deformable in the vertical direction. A space in the intermediate portion 31 enclosed by the two side walls 32, the busbar holding portion 21 and the electronic component holding portion 35 is open in the vertical direction so that the electronic component holding portion 35 can receive electrodes (not shown) for resistance-welding the lead wires 62.

The electronic component holding portion 35 includes a substantially hollow cylindrical tubular portion 36 for accommodating the capacitor main body 6, rotation restricting grooves 37 for guiding the projecting portions 64 of the lead wires 62 and the spacer 38 to be arranged between the lead wires 62 of the capacitor 60. The tubular portion 36 has an axial direction aligned with the front-back direction, and a capacitor insertion opening 39 is at a rear end so that the capacitor 60 is insertable therein from behind. A front end of the tubular portion 36 also is open to enable insertion of the lead wires 62. A part of an upper part of the tubular portion 36 extends forward, and the column-like spacer 38 coupled to the intermediate coupling portion 33 projects down from this extending part. The spacer 38 prevents the lead wires 62 from contacting one another and prevents a forward movement of the capacitor main body 61 from a specified position.

Figure 6:
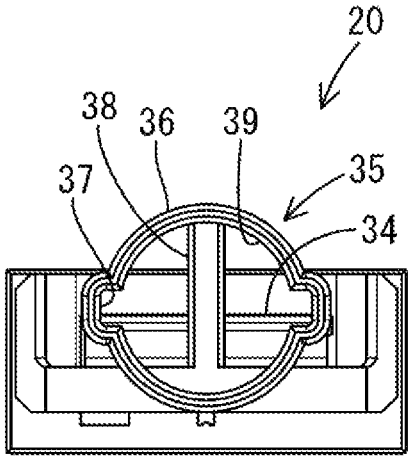
FIG. 6 is a rear view of the holder.

As shown in FIGS. 6 and 7, the rotation restricting grooves 37 are continuous with partial cut parts on opposite left and right sides of a central part of the tubular portion 36 in the height direction. Thus, the rotation restricting grooves 37 are located radially outward of the tubular portion 36 and communicate with a space formed by the tubular portion 36 for accommodating the capacitor main body 61. Lower ends of the rotation restricting grooves 37 are at substantially the same heights as the upper surface of the lead wire support 34. Further, the rotation restricting grooves 37 are formed over the entire length of the tubular portion 36 in the front-back direction, and a distance W3 between the rotation restricting grooves 37 is slightly larger than the distance W1 between the outer sides of the projecting portions 64 to allow slight lateral displacements when inserting the lead wires 62. The projecting portions 64 are inserted into the rotation restricting grooves 37 and are guided while suppressing vertical and circumferential movements. Note that the rear ends of the rotation restricting grooves 37 and the tubular portions 36 are widened out radially to facilitate insertion of the capacitor 60.

Figure 2:
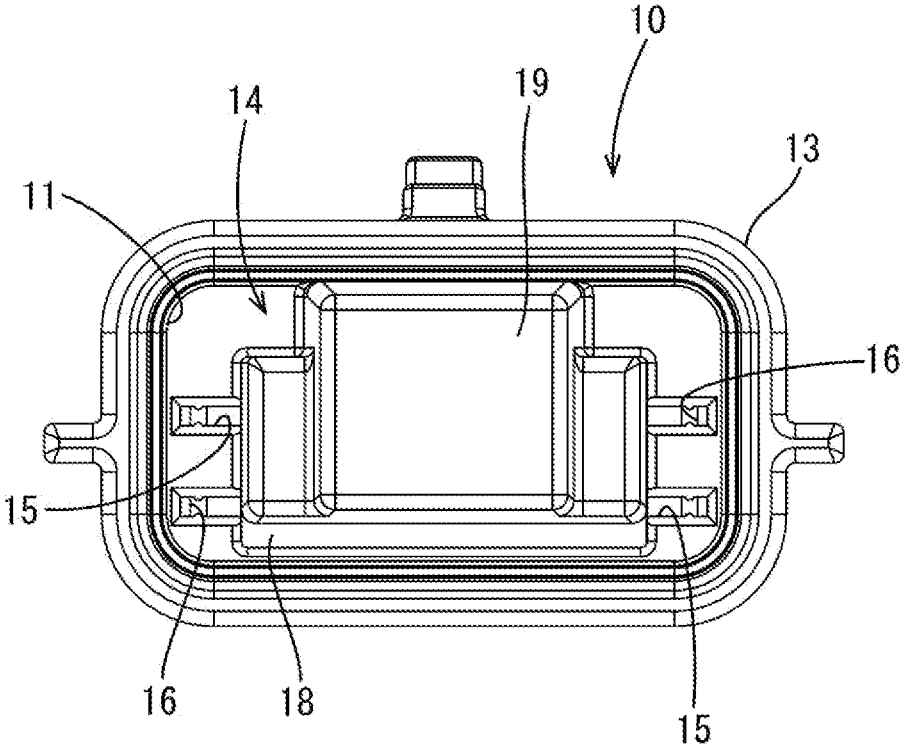
FIG. 2 is a front view of a housing.
Figure 3:
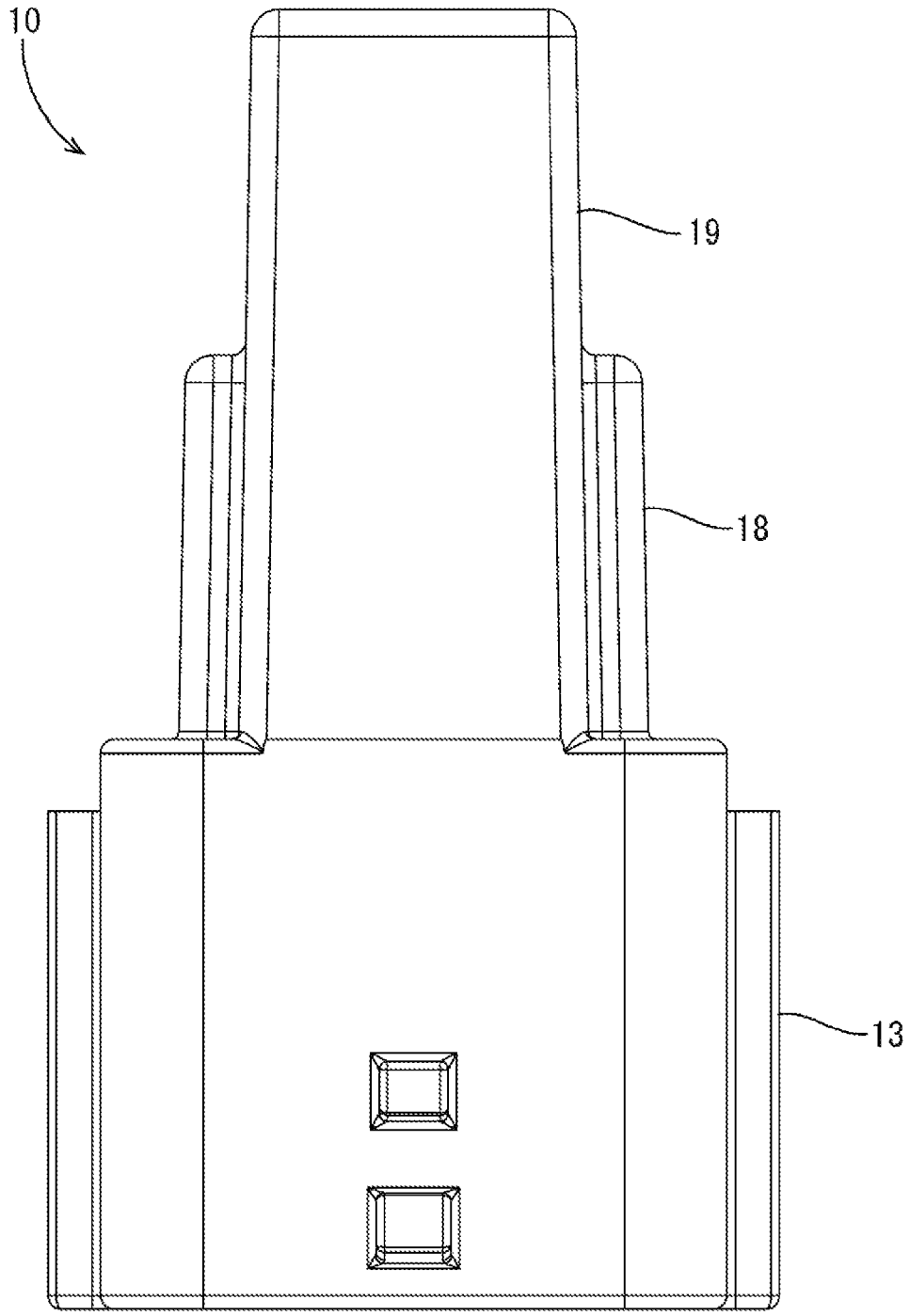
FIG. 3 is a plan view of the housing.

As shown in FIGS. 2, 3 and 15, the bottom surface 14 of the receptacle 13 is recessed back to form the holder accommodating portion 18 and the capacitor accommodating portion 19. Housing insertion grooves 15 are formed at opposite left and right sides of the holder accommodating portion 18 from the bottom surface 14 of the receptacle 13 and can receive opposite ends of the strip-like couplings 43 of the busbars 40. Further, the rear surfaces of the housing insertion grooves 15 are recessed back to form the housing press-fit holes 16, and the housing press-fit portions 55 can be press-fit into the housing press-fit holes 16.

The holder accommodating portion 18 is sized to accommodate the intermediate portion 31 (see FIG. 5) of the holder 20 without looseness.

As shown in FIG. 15, the capacitor accommodating portion 19 is dimensioned to accommodate the electronic component holding portion 35 of the holder 20 with a space behind the capacitor main body 61 when the electronic component holding portion 35 is accommodated at a predetermined position.

To assemble the connector C, the first busbar 40A is mounted into the holder 20 and is pushed backward with the first electronic component connecting portion 45A in the lead. Thus, the strip-like coupling 43A is located in the mounting groove 22 in the lower level, the bent part of the first electronic component connecting portion 45A is located in the insertion hole 25 and the wide part of the first electronic component connecting portion 45A is located in the mounting groove 22 in the upper level. The first press-fit portion 51 then is press-fit into the holder press-fit hole 26 of the mounting groove 22 in the lower level and the welding portion 48A of the first electronic component connecting portion 45A projects into a hollow part of the intermediate portion 31. The pushing of the first busbar 40A is stopped when the rear end of the strip-like coupling portion 43A contacts the back surface of the mounting groove 22 in the lower level. Note that the first electronic component connecting portion 45A is not press-fit when being inserted into the insertion hole 25 and the first connecting portion insertion hole 23, and only the first press-fit portion 51 is press-fit. In this way, the first press-fit portion 51 bites into the inner peripheral surface of the holder press-fit hole 26 to hold the first busbar 40A in the busbar holding portion 21.

The second busbar 40B then is pushed back into the holder 20 with the second electronic component connecting portion 45B in the lead so that the second strip-like coupling 43B enters the mounting groove 22 in the upper level and the second electronic component connecting portion 45B is located in a front side of the second connecting portion insertion hole 24. The second press-fit portions 53 of the second electronic component connecting portion 45B then are press-fit into the second connecting portion insertion hole 24 and a tip of the second electronic component connecting portion 45B projects into the hollow part of the intermediate portion 31. The pushing of the second busbar piece 40B is stopped when the rear end surface of the second strip-like coupling 43B contacts the back surface of the mounting groove 22 in the upper level. In this way, the second press-fit portions 53 bite into inner surfaces of the second connecting portion insertion hole 24 to hold the second busbar 40B in the busbar holding portion 21.

When the busbars 40 are mounted into the holder 20, the housing press-fit portions 55 and the opposite left and right end parts of the strip-like couplings 43 project to the both left and right sides from the busbar holding portion 21.

The capacitor 60 is mounted into the electronic component holding portion 35 after the busbars 40 are mounted. The capacitor 60 is inserted through the capacitor insertion opening 39 of the tubular portion 36 with the lead wires 62 facing forward and the projecting portions 64 of the respective left and right lead wires 62 are inserted into the respective left and right rotation restricting grooves 37. The lead wires 62 are guided and inserted while vertical circumferential movements of the projecting portions 64 are suppressed by the rotation restricting grooves 37. When coming out forward from the rotation restricting grooves 37, the tips of the lead wires 62 are supported from below by the lead wire supporting portion 34 so as not be arranged below the welding portions 48 of the electronic component connecting portions 45. The insertion of the capacitor 60 is stopped when the front end surface 61A of the capacitor main body 61 contacts the rear end of the spacer 38. When the insertion of the capacitor 60 is stopped, the projecting portions 64 have entirely passed through the rotation restricting grooves 37 and the respective lead wires 62 contact the first and second welding portion 48A and 48B of the electronic component connecting portions 45 from above. When the capacitor 60 is mounted at a predetermined position, the projecting portions 64 of the lead wires 62 and the welding portions 48 are resistance-welded while being sandwiched by a pair of upper and lower electrodes for resistance welding.

Subsequently, the subassembly of the holder 20, the busbars 40 and the capacitor 60 is mounted into the housing 10 through the insertion opening 11 with the capacitor 60 in the lead. The busbars 40 are pushed by pressing ends of the strip-like couplings 43 that project from the holder 20 and the housing press-fit portions 55 of the busbars 40 are press-fit into the housing press-fit holes 16. Pushing is stopped when the rear end surfaces of the ends of the strip-like couplings 43 that project from the holder 20 contact rear surfaces of the housing insertion grooves 15. The holder 20 and the busbars 40 are at their predetermined positions in the housing 10 when the pushing of the busbars 40 is stopped. In this way, the housing press-fit portions 55 bite into the inner peripheral surfaces of the housing press-fit holes 16 to hold the busbars 40 in the housing 10. Further, the busbars 40 also are held in the holder 20 so that the housing 10 and the holder 20 are fixed via the busbars 40.

As described above, the projecting portions 64 are formed on projecting end parts of the lead wires 62 projecting radially out of the outer peripheral surface of the capacitor main body 61. The tips of the projecting portions 64 are inserted into the capacitor insertion opening 39 of the electronic component holding portion 35 as the capacitor 60 is inserted into the electronic component holding portion 35. At that time, the projecting portions 64 are inserted into the rotation restricting grooves 37 to prevent circumferential movements of the capacitor 60 during the insertion. Further, the rotation restricting grooves 37 and the projecting portions 64 can be positioned easily in the capacitor insertion opening 39. Furthermore, the lead wires 62 are arranged at predetermined positions by the rotation restricting grooves 37 so that the lead wires 62 will not collide with the electronic component holding portion 35.

The electronic component holding portion 35 is a hollow cylinder that is open in the front-back inserting direction and the rotation restricting grooves 37 are formed in the hollow cylindrical electronic component holding portion 35. The lead wires 62 are bent to form the projecting portions 64 after projecting in the axial direction from the front end surface 61A of the capacitor main body 61. The lead wires 62 are bent out near the capacitor main body 61 and enter the rotation restricting grooves 37 to prevent circumferential movements of the lead wires 62. The projecting portions 64 are formed over substantially the entire lengths of the lead wires 62 so that long parts of the lead wires 62 are guided by the rotation restricting grooves 37 when inserting the capacitor 60.

The holder 20 includes the busbar holding portion 21 for holding the busbars 40, and the busbar holding portion 21 and the electronic component holding portion 35 are coupled while leaving a space where the busbars 40 and the lead wires 62 can be welded. Thus, the holder 20 holds both members when the lead wires 62 and the busbars 40 are welded. Therefore, operability can be improved.

The invention is not limited to the above described embodiment. For example, the following embodiments also are included in the scope of the invention.

The lead wires 62 of the capacitor 60 are round pins in the above embodiment. However, the lead wires of the capacitor may be, for example, in the form of rectangular columns.

The electronic component is a capacitor 60 in the above embodiment. However, the electronic component may be any one of various electronic components such as resistors, diodes and transistors as long as it has a solid cylindrical shape and a lead wire projects from one end surface.

Although the busbars 40 are held in the holder 20 in the above embodiment, they may be connected to the electronic component in a state not held in the holder 20.

The housing 10 of the above embodiment may be omitted. Further, a connector may be configured so that a holder and a housing are integral.

A guide portion is formed by the rotation restricting grooves 37 in the above embodiment, but it may have another shape with a surface for preventing circumferential movements. Further, the hollow cylindrical shape of the electronic component holding portion may be divided into a plurality of sections and the projecting portions of the lead wires may be passed between divided surfaces. Alternatively, cuts may be provided on parts of the divided surfaces and the projecting portions of the lead wires may be passed through the cut parts.

The rotation restricting grooves are provided over the entire length of the electronic component holding portion in the front-back direction in the above embodiment. However, they may not be provided over the entire length as long as they are provided in the capacitor insertion opening and the projecting portions of the lead wires can be passed therethrough.

The electronic component holding portion has a hollow cylindrical shape open in the front-back direction in the above embodiment, but a wall may be provided on a front side. Further, if the inner peripheral surface is substantially circumferential, the electronic component holding portion may have another shape.

The projecting portions of the lead wires are formed by cranking the lead wires 62 near the capacitor main body in the above embodiment. However, they may be formed by bending insertion sides thereof outward or outwardly widening a spacing between the tip parts of the lead wires. Further, the lead wires may be entirely arranged obliquely outward from the end parts thereof near the capacitor main body.

What is claimed is:

1. A connector, comprising:

an electronic component including a solid cylindrical electronic component main body and lead wires projecting in an axial direction from one axial end surface of the electronic component main body, each of the lead wires including a projecting portion projecting radially outward of an outer peripheral surface of the electronic component main body;

terminals to be connected respectively to the lead wires; and a holder made of synthetic resin and including;

a tubular electronic component holding portion having an insertion opening into which the electronic component is inserted in the axial direction of the electronic component main body, the electronic component holding portion including a main body accommodating portion for accommodating the electronic component main body and grooves open into the main body accommodating portion and extending from the insertion opening substantially parallel to the axial direction, the grooves being located radially outward of the electronic component main body and being configured to guide the projecting portions sufficiently toward a back side in an inserting direction of the electronic component holding portion so that the leads project rearward of the electronic component holding portion while suppressing a circumferential movement of the electronic component, a terminal holding portion configured to hold the terminals; and an intermediate portion between the electronic component holding portion and the terminal holding portion and being open on at least one side to permit connection of the lead wires of the electronic component to the terminals.

2. The connector with of claim 1, wherein:

the electronic component holding portion defines a hollow cylinder open in a front-back direction;

the grooves are diametrically opposed on the hollow cylindrical electronic component holding portion; and the lead wires are formed with the projecting portions by bending end parts thereof toward a radially outer side after projecting in the axial direction from the one end of the electronic component main body.

3. The connector of claim 1, wherein:

the terminal holding portion and the electronic component holding portion are coupled while leaving a space at the intermediate portion where the terminal and the lead wire are weldable.

4. The connector of claim 1, wherein each of the grooves extends along an entire length of the main body accommodating portion.

5. The connector of claim 1, wherein the intermediate portion comprises to parallel spaced-apart walls extending from the electronic component holding portion to the terminal holding portion, the connection of the lead wires from the electronic component to the terminals being between the spaced apart walls of the intermediate portion.

6. The connector of claim 5, wherein the holder further comprises a coupling extending between the spaced-apart walls of the holder at a position substantially adjacent the electronic component holding portion for supporting the lead wires at locations in proximity to the terminals.

7. The connector of claim 6 further comprising a spacer projecting from the coupling at a position adjacent the electronic component holding portion, the spacer being dimensioned for limiting axial movement of the electronic component into the electronic component holding portion.

8. The connector of claim 1, wherein the terminals are busbars.

9. The connector of claim 8, wherein the terminal holding portion includes a plurality of slots for slidably accommodating and positioning the busbars.

* * * * *